US012729473B2

(12) United States Patent
Ewing

(10) Patent No.: US 12,729,473 B2
(45) Date of Patent: Sep. 8, 2026

(54) LOAD REDISTRIBUTION PROCEDURE FOR A WASHING MACHINE APPLIANCE

(71) Applicant: Haier US Appliance Solutions, Inc., Wilmington, DE (US)

(72) Inventor: Cody Ewing, Floyds Knobs, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 50 days.

(21) Appl. No.: 18/783,974

(22) Filed: Jul. 25, 2024

(65) Prior Publication Data

US 2026/0028761 A1 Jan. 29, 2026

(51) Int. Cl.

| | |
|---|---|
| ***D06F 33/48*** | (2020.01) |
| ***D06F 23/04*** | (2006.01) |
| ***D06F 33/40*** | (2020.01) |
| ***D06F 33/42*** | (2020.01) |
| ***D06F 33/44*** | (2020.01) |
| ***D06F 34/04*** | (2020.01) |
| ***D06F 34/06*** | (2020.01) |
| ***D06F 34/16*** | (2020.01) |
| ***D06F 34/28*** | (2020.01) |
| ***D06F 39/14*** | (2006.01) |
| *D06F 101/00* | (2020.01) |
| *D06F 103/26* | (2020.01) |

(Continued)

(52) U.S. Cl.

CPC ..... *D06F 33/48* (2020.02); *D06F 23/04* (2013.01); *D06F 33/40* (2020.02); *D06F 33/42* (2020.02); *D06F 33/44* (2020.02); *D06F 34/04* (2020.02); *D06F 34/06* (2020.02); *D06F 34/16* (2020.02); *D06F 34/28* (2020.02); *D06F 39/14* (2013.01); *D06F 2101/00* (2020.02); *D06F 2103/26* (2020.02); *D06F 2105/44* (2020.02); *D06F 2105/52* (2020.02); *D06F 2105/56* (2020.02); *D06F 2105/58* (2020.02)

(58) Field of Classification Search

CPC ..... D06F 33/48; D06F 34/06; D06F 33/42; D06F 33/44; D06F 34/04; D06F 33/40; D06F 34/28; D06F 34/16; D06F 23/04; D06F 39/14; D06F 2103/26; D06F 2105/44; D06F 2105/52; D06F 2105/58; D06F 2105/56; D06F 2101/00

USPC ..... 68/12.01

See application file for complete search history.

(56) References Cited

U.S. PATENT DOCUMENTS

| | | | |
|---|---|---|---|
| 7,581,272 | B2 | 9/2009 | Xie et al. |
| 7,739,764 | B2 | 6/2010 | Zhang et al. |

(Continued)

FOREIGN PATENT DOCUMENTS

| | | | |
|---|---|---|---|
| CN | 110629453 | A | 12/2019 |
| CN | 112281413 | A | 1/2021 |

(Continued)

*Primary Examiner* — Tinsae B Ayalew

(74) *Attorney, Agent, or Firm* — Dority & Manning, P.A.

(57) ABSTRACT

A method of operating a washing machine appliance may include directing a spin cycle of the washing machine appliance. The method may include identifying an out-of-balance condition during the spin cycle. The method may include suspending the spin cycle in response to identifying the out-of-balance condition during the spin cycle. The method may include providing a redistribution notification at a user interface following suspending the spin cycle. The redistribution notification may indicate a potential load redistribution procedure.

16 Claims, 4 Drawing Sheets

(51) Int. Cl.

| | |
|---|---|
| *D06F 105/44* | (2020.01) |
| *D06F 105/52* | (2020.01) |
| *D06F 105/56* | (2020.01) |
| *D06F 105/58* | (2020.01) |

(56) References Cited

U.S. PATENT DOCUMENTS

| | | | | |
|---|---|---|---|---|
| 7,958,585 | B2 | 6/2011 | Zhang et al. | |
| 9,267,226 | B2 | 2/2016 | Suel, II | |
| 9,328,451 | B2 | 5/2016 | Didat | |
| 9,428,854 | B2 | 8/2016 | Dunn et al. | |
| 12,060,670 | B2 | 8/2024 | Kellow | |
| 2004/0060123 | A1 | 4/2004 | Lueckenbach et al. | |
| 2005/0257397 | A1 | 11/2005 | Woerdehoff et al. | |
| 2015/0284895 | A1 | 10/2015 | Davis et al. | |
| 2020/0010999 | A1 | 1/2020 | Lee et al. | |
| 2022/0349103 | A1* | 11/2022 | Kellow | D06F 33/48 |
| 2023/0383455 | A1* | 11/2023 | Hu | D06F 33/47 |

FOREIGN PATENT DOCUMENTS

| | | | |
|---|---|---|---|
| CN | 110359222 | B | 4/2023 |
| JP | 2005230315 | A | 9/2005 |
| KR | 2020121643 | A | 10/2020 |
| WO | WO2017004787 | A1 | 1/2017 |

* cited by examiner

LOAD REDISTRIBUTION PROCEDURE FOR A WASHING MACHINE APPLIANCE

FIELD OF THE DISCLOSURE

The present subject matter relates generally to a washing machine appliance, and more particularly to a method of operating a washing machine appliance.

BACKGROUND OF THE DISCLOSURE

Washing machine appliances generally include a cabinet which receives a wash tub for containing water or wash fluid (e.g., water and detergent, bleach, or other wash additives). The wash tub may be suspended within the cabinet by a suspension system to allow some movement relative to the cabinet during operation. A wash basket is rotatably mounted within the wash tub and defines a wash chamber for receipt of articles for washing. A drive assembly is coupled to the wash tub and is configured to selectively rotate the wash basket within the wash tub.

Washing machine appliances are typically equipped to operate in one or more modes or cycles, such as wash, rinse, and spin cycles. For example, during a wash or rinse cycle, the wash fluid is directed into the wash tub in order to wash or rinse articles within the wash chamber. In addition, the wash basket or an agitation element can rotate at various speeds to agitate or impart motion to articles within the wash chamber. During a spin cycle, the wash basket may be rotated at high speeds (e.g., to wring wash fluid from articles within the wash chamber).

A significant concern during operation of washing machine appliances is out-of-balance conditions within the wash tub. For example, articles and water loaded within a wash basket may not be equally weighted about a central axis of the wash basket and wash tub. Accordingly, when the wash basket rotates, in particular during a spin cycle, the imbalance in clothing weight may cause the wash basket to be out-of-balance within the wash tub, such that the axis of rotation does not align with the axis of the cylindrical wash basket or wash tub. Such out-of-balance issues can cause the wash basket to contact the wash tub during rotation and can further cause movement of the wash tub within the cabinet. Significant movement of the wash tub can, in turn, generate increased noise, vibrations, washer "walking," or cause excessive wear and premature failure of appliance components.

Various methods are known for addressing out-of-balance conditions within the washing machine appliance. However, such methods have numerous drawbacks. For example, such methods can require multiple attempts to remedy the out-of-balance condition, thus increasing cycle times. As another example, such methods often require large amounts of additional water to be added to the wash basket to attempt to remedy the out-of-balance condition, thus increasing the cost to a consumer.

Accordingly, a washing machine appliance that obviates one or more of the above-mentioned drawbacks would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a method of operating a washing machine appliance is provided. The method may include directing a spin cycle of the washing machine appliance. The method may include suspending the spin cycle in response to identifying the out-of-balance condition during the spin cycle. The method may include providing a redistribution notification at a user interface following suspending the spin cycle. The redistribution notification may indicate a potential load redistribution procedure.

In another exemplary aspect of the present disclosure, a washing machine appliance is provided. The washing machine appliance may include a user interface. The washing machine appliance may include controller in operable communication with the user interface, the controller operable for: directing a spin cycle of the washing machine appliance; identifying an out-of-balance condition during the spin cycle; suspending the spin cycle in response to identifying the out-of-balance condition during the spin cycle; providing a redistribution notification at a user interface following suspending the spin cycle, the redistribution notification indicating a potential load redistribution procedure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
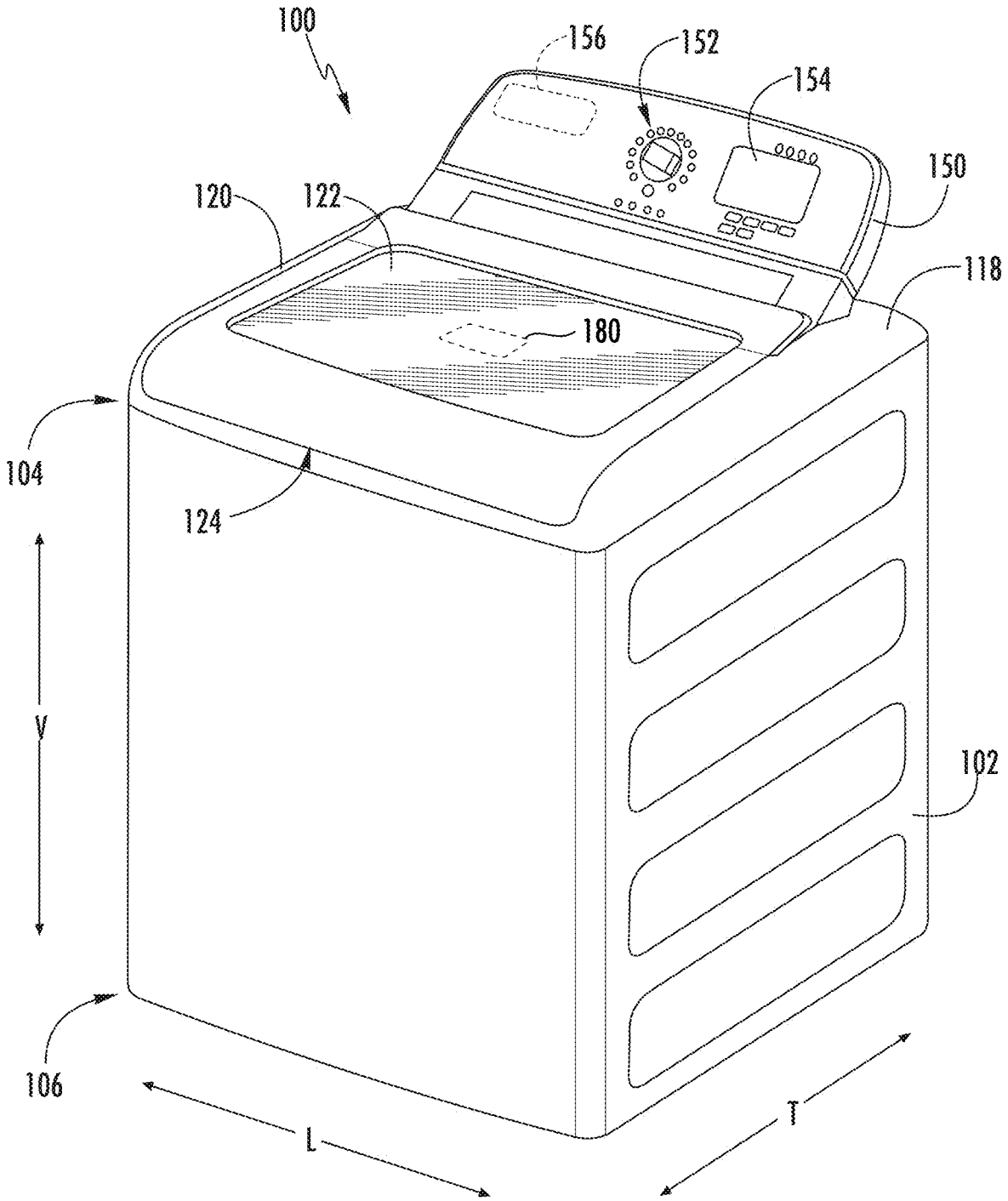
FIG. 1 provides a perspective view of a washing machine appliance according to one or more exemplary embodiments of the present subject matter with a door of the exemplary washing machine appliance shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, reference to "an embodiment" or "one embodiment" does not necessarily refer to the same embodiment, although it may. Any implementation described herein as "exemplary" or "an embodiment" is not necessarily to be construed as preferred or advantageous over other implementations.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Commonly, washing machine appliances include systems and methods for addressing out-of-balance conditions that may occur during an operation cycle of the washing machine appliance. For example, washing machine appliances can monitor the motion of a wash tub during an operation cycle (e.g., a spin cycle) of the washing machine appliance. In cases where the motion of the wash tub is extreme (e.g., in excess of a predetermined threshold), most washing machine appliances have the ability to pause the operation cycle and perform a redistribution procedure to attempt to correct the out-of-balance condition.

Typical redistribution procedures are intended to be unobtrusive to a user of the washing machine appliance. For example, typical redistribution procedures are intended to correct out-of-balance conditions without user input. However, these unobtrusive redistribution procedures have numerous drawbacks and are rarely fully effective. For example, the unobtrusive redistribution procedures can require a large amount of additional water to be filled into the wash tub. This additional water can increase operation costs (e.g., to a user). As another example, the unobtrusive redistribution procedure can increase the operation time of the washing machine appliance. Specifically, the unobtrusive redistribution procedure can require multiple iterations of the redistribution procedure to potentially correct the out-of-balance condition.

Notably, embodiments of the present subject matter provide a method of operating a washing machine appliance. As will be appreciated, the method includes a load redistribution procedure for a washing machine appliance. The load redistribution procedure can pause the operation cycle of the washing machine appliance when an out-of-balance condition is identified. The load redistribution procedure can then inform the user of an impending redistribution. In response to the information, the user can choose to either manually correct the out-of-balance condition or allow the redistribution procedure to continue as normal.

Embodiments of the present subject matter can advantageously reduce or mitigate additional water usage during operation of the washing machine appliance. Embodiments of the present subject matter can advantageously reduce or mitigate additional cycle time. Embodiments of the present subject matter can advantageously mitigate or prevent out-of-balance conditions and its negative effects. For example, negative effects of out-of-balance conditions can include increased tub motion, loud noises caused by cabinet strikes, or the like. These negative effects can lead to excessive wear and tear on the washing machine appliance.

Figure 2:
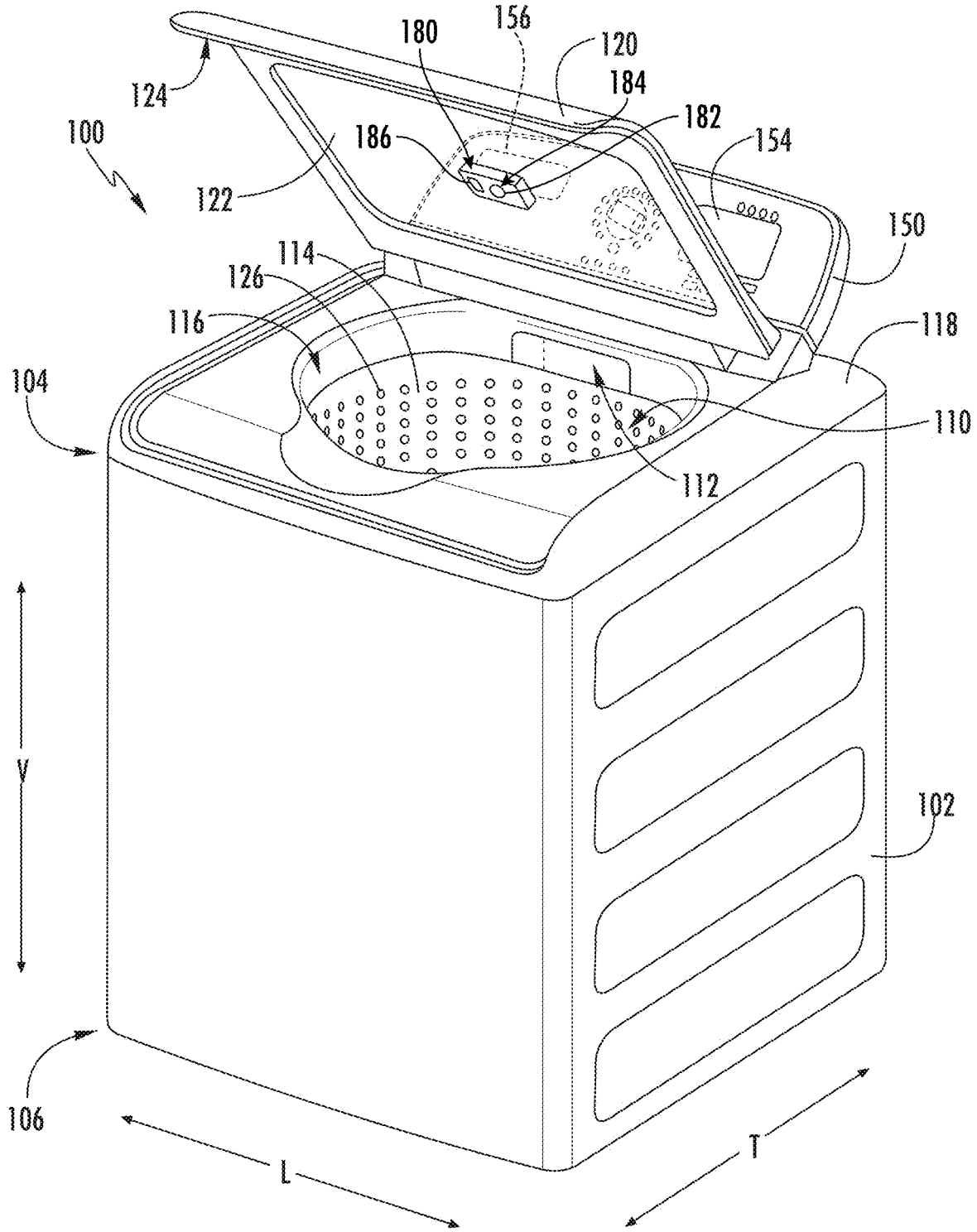
FIG. 2 provides a perspective view of the exemplary washing machine appliance of FIG. 1 with the door of the exemplary washing machine appliance shown in an open position.
Figure 3:
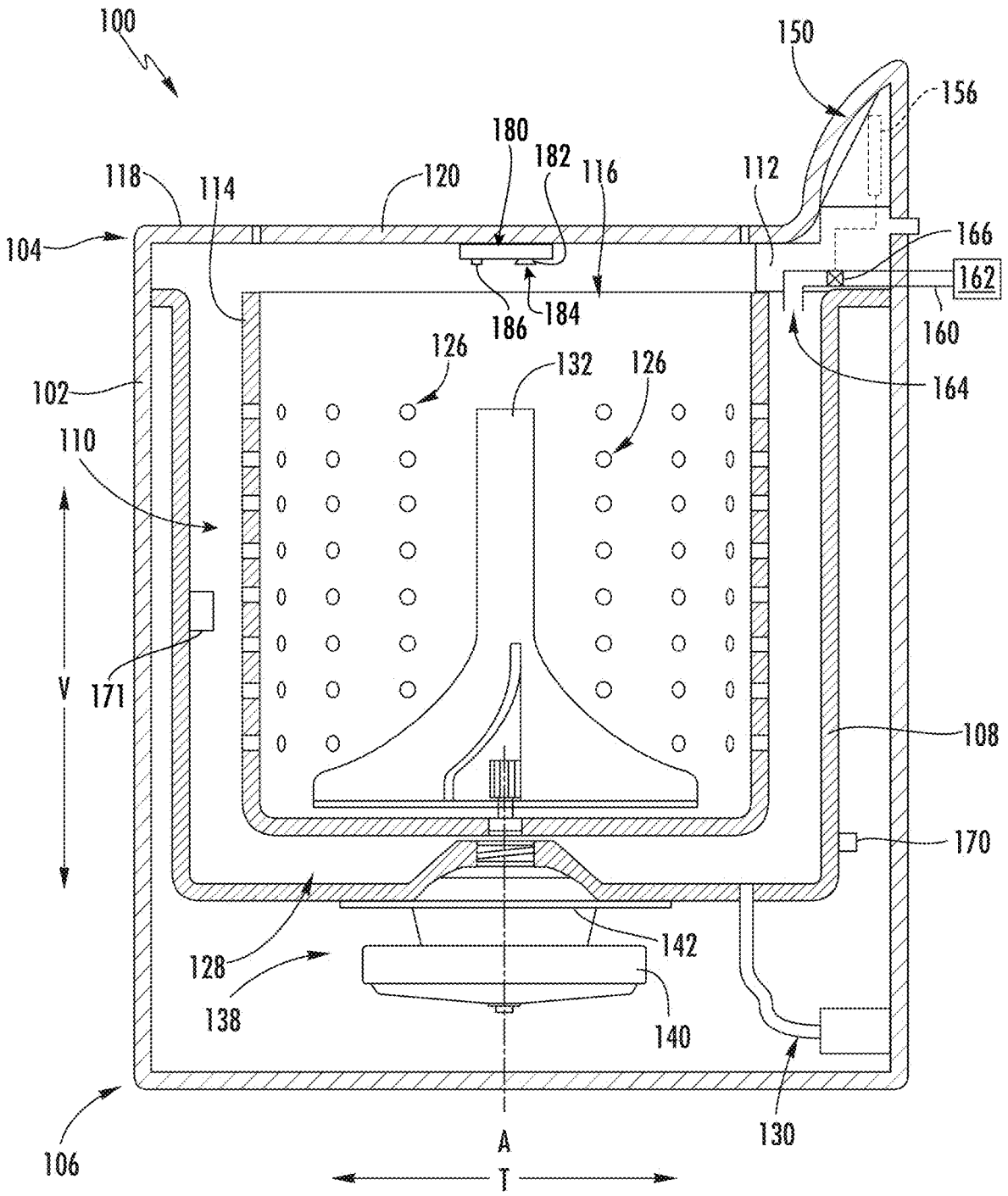
FIG. 3 provides a side cross-sectional view of the exemplary washing machine appliance of FIG. 1.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, or different features while remaining within the scope of the present subject matter.

Washing machine appliance 100 has a cabinet 102 that extends between a top portion 104 and a bottom portion 106 along the vertical direction V, between a first side (e.g., the left side when viewed from the front) and a second side (e.g., the right side when viewed from the front) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser 112 (FIG. 2) for dispensing wash fluid into wash tub 108. The term "wash fluid" refers to a liquid used for washing or rinsing articles during an operating cycle and may include any combination of water, detergent, fabric softener, bleach, and other wash additives or treatments.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (e.g., FIG. 2) that coincides with opening 116 of wash basket 114 to permit a user access to wash basket 114. Washing machine appliance 100 further includes a door 120 which is rotatably mounted to top panel 118 to permit selective access to opening 116. Door 120 selectively rotates between the closed position (e.g., FIGS. 1 and 3) and the open position (e.g., FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (e.g., FIG. 3) that is located beneath wash tub 108 and wash basket 114 for gravity assisted flow when draining wash tub 108.

An impeller or agitation element 132 (e.g., FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 to selectively rotate wash basket 114 (e.g., during an agitation cycle, a spin cycle, or a rinse cycle, or the like). In addition, motor assembly 138 may also be in mechanical communication with agitation element 132. In this manner, motor assembly 138 may be configured for selectively rotating or oscillating wash basket 114 or agitation element 132 during various operating cycles of washing machine appliance 100.

More specifically, motor assembly 138 may generally include one or more of a drive motor 140 and a transmission assembly 142, e.g., such as a clutch assembly, for engaging and disengaging wash basket 114 or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring still to FIGS. 1 through 3, a control panel 150 with at least one input selector 152 (e.g., FIG. 1) extends from top panel 118. Control panel 150 and input selector 152 collectively form a user interface input for operator selection of machine cycles and features. A display 154 of control panel 150 indicates selected features, operation mode, a countdown timer, or other items of interest to appliance users regarding operation.

Operation of washing machine appliance 100 is controlled by a processing device or controller 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent or other fluid additives via primary dispenser 112. One or more valves can be controlled by washing machine appliance 100 to provide for filling wash tub 108 and wash basket 114 to the appropriate level for the amount of articles being washed or rinsed. By way of example for a wash mode, once wash basket 114 is properly filled with fluid, the contents of wash basket 114 can be agitated (e.g., with agitation element 132 as discussed previously) for washing of laundry items in wash basket 114.

More specifically, referring again to FIG. 3, a water fill process will be described according to an exemplary embodiment. As illustrated, washing machine appliance 100 includes a water supply conduit 160 that provides fluid communication between a water supply source 162 (such as a municipal water supply) and a discharge nozzle 164 for directing a flow of water into wash chamber 110. In addition, washing machine appliance 100 includes a water fill valve or water control valve 166 which is operably coupled to water supply conduit 160 and communicatively coupled to controller 156. In this manner, controller 156 may regulate the operation of water control valve 166 to regulate the amount of water within wash tub 108.

Although water supply conduit 160, water supply source 162, discharge nozzle 164, and water control valve 166 are all described and illustrated herein in the singular form, it should be appreciated that these terms may be used herein generally to describe a supply plumbing for providing hot or cold water into wash chamber 110. In this regard, water supply conduit 160 may include separate conduits for receiving hot and cold water, respectively. Similarly, water supply source 162 may include both hot- and cold-water supplies regulated by dedicated valves. In addition, washing machine appliance 100 may include one or more pressure sensors 170 for detecting the amount of water and or clothes within wash tub 108. For example, pressure sensor 170 may be operably coupled to a side of tub 108 for detecting the weight of wash tub 108, which controller 156 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle or after the rinse cycle in order to wring wash fluid from the articles being washed. During a spin cycle, wash basket 114 is rotated at relatively high speeds to help wring fluid from the laundry articles through perforations 126. During or prior to the spin cycle, drain pump assembly 138 may operate to discharge wash fluid from wash tub 108, e.g., to an external drain. After articles disposed in wash basket 114 are cleaned or washed, the user can remove the articles from wash basket 114, e.g., by reaching into wash basket 114 through opening 116.

The controller 156 of washing machine appliance 100 (or any other suitable dedicated controller) may be communicatively coupled to one or more components that may facility in the monitoring and identification of an out-of-balance condition of the wash basket. For example, as illustrated, the washing machine appliance may include a camera assembly 180, tub light 186, and other components of washing machine appliance 100. Controller 156 may be programmed or configured for analyzing the images obtained by camera assembly 180, e.g., in order to determine the level of water or wash fluid within wash chamber 110 or other cycle information, to make informed decisions regarding the operation of washing machine appliance 100.

Referring now specifically to FIGS. 2 and 3, washing machine appliance 100 may further include a camera assembly 180 that is generally positioned and configured for obtaining images of a load of clothes within wash chamber 110 of washing machine appliance 100. Specifically, according to the illustrated embodiment, camera assembly 180 may include a camera 182 mounted to an underside of door 120 of washing machine appliance 100. In this manner, when door 120 is in the closed position, camera 182 may be positioned over wash chamber 110 and may be oriented for obtaining images within wash chamber 110. Specifically, camera 182 is mounted such that is faces toward a bottom side of wash tub 108. In this manner, camera 182 can take unobstructed images or video of an inside of wash chamber 110.

It should be appreciated that camera assembly 180 may include any suitable number, type, size, and configuration of camera(s) 182 for obtaining images of wash chamber 110. In general, cameras 182 may include a lens 184 that is constructed from a clear hydrophobic material or which may otherwise be positioned behind a hydrophobic clear lens. So positioned, camera assembly 180 may obtain one or more images or videos of the wash tub 108, and more particularly clothes within wash chamber 110. It should be appreciated that other locations for mounting camera assembly 180 are possible, such as below or adjacent a discharge nozzle 164 of washing machine appliance 100.

Referring still to FIGS. 2 through 3, washing machine appliance 100 the tub light 186 that may be positioned within cabinet 102 or wash chamber 110 for selectively illuminating wash chamber 110 and the load of clothes positioned therein. Specifically, as shown in FIG. 2, tub light 186 may be integrated into camera assembly 180 and may be positioned immediately adjacent camera 182. According to still other embodiments, tub light 186 may be positioned at any other suitable location within cabinet 102. It should be appreciated that according to alternative embodiments, washing machine appliance 100 may include any other camera or system of imaging devices for obtaining images of the load of clothes. In addition, these cameras may be positioned at any suitable location within cabinet 102, may include any suitable lighting features, and may utilize any suitable photography or imaging technology.

In additional or alternative exemplary embodiments, the washing machine appliance 100 may include one or more additional or alternative components that may monitor or identify out-of-balance conditions of the washing machine appliance 100. For example, the washing machine appliance 100 may include a measurement device 171 for measuring translational motion, such as acceleration along one or more directions of the wash basket 114. For example, the measurement device 171 can include a gyroscope, encoder, or other measurement devices, which measures rotational motion, such as rotational velocity about an axis (e.g., an axis of rotation of the wash basket 114). In some embodiments, the measurement device 171 is mounted to the wash tub 108 or the wash basket 114 to sense movement relative to the cabinet 102 by measuring uniform periodic motion, non-uniform periodic motion, or excursions of the wash tub 108 during operation of the washing machine appliance 100.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, or different features may also be utilized with the present subject matter as well, e.g., horizontal axis washing machine appliances. In addition, aspects of the present subject matter may be utilized in a combination washer/dryer appliance.

Now that the construction of washing machine appliance 100 and the configuration of controller 156 according to exemplary embodiments have been presented, an exemplary method 200 of operating a washing machine appliance will be described. Although the discussion below refers to the exemplary method 200 of operating washing machine appliance, one skilled in the art will appreciate that the exemplary method 200 is applicable to the operation of a variety of other washing machine appliances, such as horizontal axis washing machine appliances. In exemplary embodiments, the various method steps as disclosed herein may be performed by controller 156 or a separate, dedicated controller.

Figure 4:
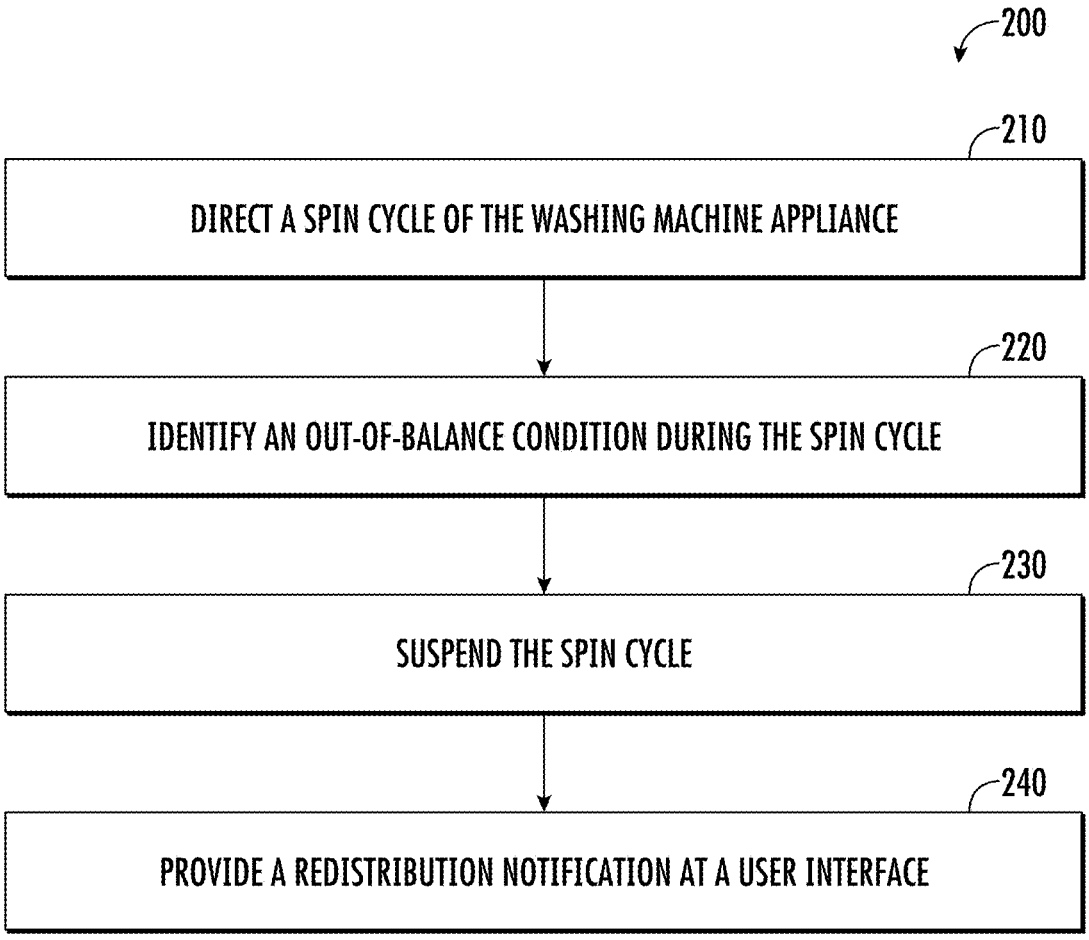
FIG. 4 provides a flow diagram of an exemplary process for implementing a load redistribution procedure for a washing machine appliance according to one or more exemplary embodiments of the present subject matter.

Referring now to FIG. 4, at 210, the method 200 includes directing a spin cycle of the washing machine appliance. In some embodiments, directing the spin cycle of the washing machine appliance includes operating a motor assembly of the washing machine appliance to rotate the wash basket. Particularly, during the spin cycle, the motor assembly may drive rotation of the wash basket. The wash basket may rotate at relatively high speeds to help wring fluid from the wash basket through perforations defined in a side wall of the wash basket. For example, the spin cycle may wring wash fluid from articles being washed (e.g., within the wash chamber). During or prior to the spin cycle, a drain pump assembly may operate to discharge wash fluid from wash to (e.g., to an external drain). In some embodiments, the spin cycle is directed after a wash cycle or after a rinse cycle of the washing machine appliance has been performed.

At 220, the method 200 includes identifying an out-of-balance condition during the spin cycle. An out-of-balance condition may occur during the spin cycle because of an uneven distribution of the load of articles within the wash chamber. Generally, any suitable method for detecting an imbalance or an out-of-balance condition in which the center of mass of the wash basket (and articles therein) is no longer aligned with a shaft center of the washing machine may be used. As an example, the OOB state may be detected based on more received signals from a measurement device (e.g., accelerometer or gyroscope) during rotation of the basket (e.g., during the spin phase). As an additional or alternative example, the OOB may be detected based on one or more received signals from the basket's motor (e.g., or a sensor thereof).

In some embodiments, identifying the out-of-balance condition may include monitoring at least one component (e.g., the wash basket, the wash tub, the load of articles within the wash chamber, or the like) of the washing machine appliance. Monitoring the at least one component may include recording distribution data of the at least one component of the washing machine appliance. Recording the distribution data may include measuring or sensing one or more physical parameters of the at least one component. For example, data related to the rotation of the wash basket may be recorded. As another example, data related to the load of articles within the wash basket may be recorded. In addition, monitoring the at least one component may include analyzing the recorded distribution data of the at least one component. Analyzing the distribution data may include comparing the recorded distribution data to predetermined distribution data sets. The predetermined distribution data sets may include historical distribution data or reference distribution data that is stored within a memory associated with the washing machine appliance. The comparison of the recorded distribution data to the predetermined distribution data set may indicate if the washing machine appliance is experiencing an out-of-balance condition.

At 230, the method 200 includes suspending the spin cycle in response to identifying the out-of-balance condition during the spin cycle. Suspending the spin cycle may include ceasing or halting (e.g., temporarily), the operation of the motor assembly. In this regard, suspending the spin cycle may include halting rotation of the wash basket. Notably, suspending the spin cycle in response to identifying the out-of-balance condition advantageously reduces or mitigates noise or vibration produced by the washing machine appliance (e.g., when compared to traditional washing machine appliances that may continue the spin cycle when an out-of-balance condition is detected).

At 240, the method 200 includes providing a redistribution notification at a user interface following suspending the spin cycle. For example, the user interface may be onboard a control panel of the washing machine appliance. In such instances, the redistribution notification is provided at the washing machine appliance. As another example, the user interface may be onboard an external device (e.g., a smartphone, tablet, laptop, smartwatch, or the like) in operative communication with a controller of the washing machine appliance. In such instances, the redistribution notification is provided at the external device. For example, the redistribution notification can be displayed on a user interface of the external device. The redistribution notification may be indicative of a potential load redistribution procedure. For example, the redistribution notification may include a user message that indicates a load redistribution procedure will be starting in a predetermined amount of time unless the user desires another course of action. For example, the user may be prompted with the choice to determine if they would like to continue with the performance of an automatic redistribution procedure or a manual redistribution procedure.

In some embodiments, the method 200 may include initiating a countdown timer in response to providing the redistribution notification at the user interface. The countdown timer may correspond to the predetermined amount of time until the start of the impending load redistribution procedure. In some embodiments, the method 200 may include determining expiration of the countdown timer. In such embodiments, the method 200 may include directing an automatic redistribution procedure in response to expiration of the countdown timer. The automatic redistribution procedure may include no direct user interaction. For example, during the automatic redistribution procedure the user may not manipulate or otherwise interact with the washing machine appliance or the load of articles therein to initiate, perform, or complete the redistribution procedure. Moreover, the automatic redistribution procedure may include flowing an additional fill of water into the wash tub and directing an agitation cycle of the washing machine appliance. This agitation cycle may redistribute the load of articles within the wash basket.

In some other embodiments, the method 200 may include receiving an automatic redistribution signal at the user interface following providing the redistribution notification at the user interface. For example, the automatic redistribution signal may be received from the user interface in response to user manipulation at the user interface. In such embodiments, the method 200 may include directing an automatic redistribution procedure in response to receiving the automatic redistribution signal. The automatic redistribution procedure may include no direct user interaction. For example, during the automatic redistribution procedure the user may not manipulate or otherwise interact with the washing machine appliance or the load of articles therein to initiate, perform, or complete the redistribution procedure. Moreover, the automatic redistribution procedure may include flowing an additional fill of water into the wash tub and directing an agitation cycle of the washing machine appliance. This agitation cycle may redistribute the load of articles within the wash basket.

In some embodiments, the method 200 may include receiving a manual redistribution signal from the user interface following providing the redistribution notification at the user interface. The manual redistribution signal may be received at the user interface in response to user manipulation of the user interface. In such embodiments, the method 200 may include directing a manual redistribution procedure in response to receiving the manual redistribution signal. The manual redistribution procedure may be a user performed procedure. For example, the user may be prompted to manually redistribute the load of articles to remedy the out-of-balance condition.

In some embodiments, prior to directing the spin cycle at 210, the method 200 may include locking a door of the washing machine appliance. For example, a locking mechanism attached to the door of the washing machine appliance may lock or secure the door of the washing machine appliance such that it may not be opened (e.g., by a user) during an operating cycle. In such embodiments, directing the manual redistribution may include unlocking the door of the washing machine appliance. In this regard, the user may be able to open the door of the washing machine appliance to manually redistribute the load of articles within the wash chamber. Notably, the manual redistribution procedure may advantageously reduce the amount of water utilized during operation of the washing machine appliance or may advantageously decrease the operating time of the washing machine appliance.

Moreover, in some embodiments, the method 200 includes directing a drain cycle following directing the manual redistribution procedure. For example, after the user has manually redistributed the load of articles within the wash chamber, the drain cycle may be performed. Directing the drain cycle may include draining wash fluid from the wash chamber and subsequently operating the motor assembly of the washing machine appliance to rotate the wash basket at a relative high speed. The rotation of the wash basket may wring wash fluid from the load of articles within the wash basket.

In some embodiments, the method 200 includes receiving a prevention signal from the user interface following providing the redistribution notification at the user interface. The prevention signal may be received from the user interface in response to manipulation of the user interface. In such embodiments, the method 200 may include preventing the occurrence of a redistribution procedure following receiving the prevention signal. For example, a user may desire to remove (e.g., permanently or temporarily) the possibility of a redistribution procedure occurring following an out-of-balance condition being identified. In some embodiments, preventing the occurrence of the redistribution procedure includes locking (e.g., temporarily) an algorithm or code that corresponds to a redistribution procedure of the washing machine appliance. In this regard, a redistribution procedure may not be performed until the redistribution procedure is unlocked. In some other embodiments, preventing the occurrence of the redistribution procedure includes removing (e.g., permanently) an algorithm or code stored within a memory of the controller that corresponds to the redistribution procedure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance comprising:

directing a spin cycle of the washing machine appliance;

identifying an out-of-balance condition during the spin cycle;

suspending the spin cycle in response to identifying the out-of-balance condition during the spin cycle;

providing a redistribution notification at a user interface following suspending the spin cycle, the redistribution notification indicating a potential load redistribution procedure;

receiving a manual redistribution signal from the user interface following providing the redistribution notification at the user interface; and directing a drain cycle following receiving the manual redistribution signal, wherein directing the drain cycle comprises operating a drain pump assembly to discharge wash fluid from a wash tub of the washing machine appliance.

2. The method of claim 1, further comprising:

locking a door of the washing machine appliance prior to directing the spin cycle of the washing machine appliance; and unlocking the door of the washing machine appliance in response to receiving the manual redistribution signal from the user interface.

3. The method of claim 1, further comprising:

initiating a countdown timer in response to providing the redistribution notification at the user interface, the countdown timer corresponding to a predetermined amount of time;

determining expiration of the countdown timer; and directing an automatic redistribution procedure in response to expiration of the countdown timer.

4. The method of claim 1, further comprising:

receiving an automatic redistribution signal from the user interface following providing the redistribution notification at the user interface; and directing an automatic redistribution procedure in response to receiving the automatic redistribution signal.

5. The method of claim 1, further comprising:

receiving a prevention signal from the user interface following providing the redistribution notification at the user interface; and preventing the occurrence of a redistribution procedure following receiving the prevention signal.

6. The method of claim 1, wherein the user interface is onboard an external device in operative communication with the washing machine appliance.

7. The method of claim 1, wherein directing the spin cycle comprises directing a motor assembly coupled to a wash basket rotate the wash basket.

8. The method of claim 1, wherein identifying the out-of-balance condition comprises, recording distribution data of at least one component of the washing machine appliance, and analyzing the distribution data of the at least one component of the washing machine appliance following recording the distribution data.

9. A washing machine appliance comprising:

a user interface; and controller in operable communication with the user interface, the controller configured to store instruction, that when executed, causes the controller to execute operations, the operations comprising:

directing a spin cycle of the washing machine appliance;

identifying an out-of-balance condition during the spin cycle;

suspending the spin cycle in response to identifying the out-of-balance condition during the spin cycle;

providing a redistribution notification at the user interface following suspending the spin cycle, the redistribution notification indicating a potential load redistribution procedure;

receiving a manual redistribution signal from the user interface following providing the redistribution notification at the user interface; and directing a drain cycle following receiving the manual redistribution signal, wherein directing the drain cycle comprises operating a drain pump assembly to discharge wash fluid from a wash tub of the washing machine appliance.

10. The washing machine appliance of claim 9, wherein the controller is further operable for:

locking a door of the washing machine appliance prior to directing the spin cycle of the washing machine appliance; and unlocking the door of the washing machine appliance in response to receiving the manual redistribution signal from the user interface.

11. The washing machine appliance of claim 9, wherein the controller is further operable for:

initiating a countdown timer in response to providing the redistribution notification at the user interface, the countdown timer corresponding to a predetermined amount of time;

determining expiration of the countdown timer; and directing an automatic redistribution procedure in response to expiration of the countdown timer.

12. The washing machine appliance of claim 9, wherein the controller is further operable for:

receiving an automatic redistribution signal from the user interface following providing the redistribution notification at the user interface; and directing an automatic redistribution procedure in response to receiving the automatic redistribution signal.

13. The washing machine appliance of claim 9, wherein the controller is further operable for:

receiving a prevention signal from the user interface following providing the redistribution notification at the user interface; and preventing the occurrence of a redistribution procedure following receiving the prevention signal.

14. The washing machine appliance of claim 9, wherein the user interface is onboard an external device in operative communication with the washing machine appliance.

15. The washing machine appliance of claim 9, wherein directing the spin cycle comprises directing a motor assembly coupled to a wash basket rotate the wash basket.

16. The washing machine appliance of claim 9, wherein identifying the out-of-balance condition comprises, recording distribution data of at least one component of the washing machine appliance, and analyzing the distribution data of the at least one component of the washing machine appliance following recording the distribution data.

* * * * *